US005977517A

United States Patent [19]

Grosjean

[11] Patent Number: 5,977,517

[45] Date of Patent: Nov. 2, 1999

[54] ELECTRICALLY HEATED VEST

[76] Inventor: Douglas Martin Grosjean, 210 Perry St., Pemberville, Ohio 43450

[21] Appl. No.: 09/112,948

[22] Filed: Jul. 9, 1998

[51] Int. Cl.[6] ..... H05B 3/34

[52] U.S. Cl. ..... 219/211; 219/529; 219/549

[58] Field of Search ..... 219/211, 212, 219/217, 527, 528, 529, 545, 549

[56] References Cited

U.S. PATENT DOCUMENTS

| | | | |
|---|---|---|---|
| 1,691,472 | 11/1928 | Graham et al. . | |
| 2,277,772 | 3/1942 | Marick | 219/46 |
| 2,403,676 | 7/1946 | Modlinski | 2/94 |
| 2,579,383 | 12/1951 | Goudsmit | 219/46 |
| 3,644,705 | 2/1972 | Johnson | 219/211 |
| 3,858,028 | 12/1974 | Kerr | 219/211 |
| 3,999,037 | 12/1976 | Metcalf, Sr. | 219/211 |
| 4,404,460 | 9/1983 | Kerr | 219/211 |
| 4,601,067 | 7/1986 | Buonassissi | 2/102 |
| 5,148,002 | 9/1992 | Kuo et al. | 219/211 |
| 5,302,806 | 4/1994 | Simmons et al. | 219/21 |
| 5,750,962 | 5/1998 | Hyatt | 219/528 |

FOREIGN PATENT DOCUMENTS

| | | |
|---|---|---|
| 925139 | 4/1973 | Canada . |
| 546812 | 7/1942 | United Kingdom . |

OTHER PUBLICATIONS

Aerostich, Eight S. 18th Ave. West, Duluth, MN 55806–2148, Sales Catalog, Publication date 1997, p. 31.

Eclipse, Inc., 3771 E. Ellsworth R., Ann Arbor, MI 48108, Sales Catalog, Publication Date 1998, p. 18–19.

Widder Enterprises, 942 E. Ojai Ave., Ojai, CA 93023, Sales Brochure and price list, Publication Date Oct. 1, 1997, 6 pages total.

*Primary Examiner*—Tu Ba Hoang
*Attorney, Agent, or Firm*—Brinks Hofer Gilson & Lione

[57] ABSTRACT

An electrically heated vest which is comprised of interchangeable designed modules including at least one heating element, a removable wiring harness, a machine washable shell, and a power cord with thermostat. The interchangeable modules are anatomically shaped and identically sized. The modules are fastened to the vest via snaps, buttons, VELCRO®, or equivalent. The wiring harness is removable from the vest and has quick disconnects for the modules and power cord. The vest is machine washable, has mating fasteners for the heating elements, and an inner liner and outer shell between which the modules are attached.

13 Claims, 3 Drawing Sheets

ELECTRICALLY HEATED VEST

FIELD OF THE INVENTION

This invention relates to an electrically heated vest. More particularly, this invention relates to a heated vest of interchangeable and replaceable modules including electrical resistance elements to provide heating coverage of the upper torso of the wearer that are interconnected in parallel by a removable wiring harness.

BACKGROUND OF THE INVENTION

There is a need for heated vests in many sports and other outdoor activities, such as for example motorcycling, snowmobiling and the like. Although many of the heretofore known heated vests have performed satisfactorily, further improvements are desired.

Problems associated with prior heated vests include, for example, high voltage power sources, heavy weight, lack of freedom of mobility, difficult to repair or wash and only partial coverage of the upper torso of the wearer. Many of the prior heated vests are formed of permanently fixed heating elements or removable heating elements. It will be appreciated that those vests with permanently fixed heating elements must be hand washed and hence are not easily maintained. Furthermore, many of the heated vests with removable heating elements typically are not completely removable and/or interchangeable. It will be appreciated that because the electrically heated vests must operate under a variety of conditions, failure of the heating elements and/or wiring harness of the heated vests is inevitable. Upon the failure of the heating elements and/or wiring harness the wearer will suffer the discomfort of the cold climate and may be forced to terminate the outdoor activity unless the vest can be simply and quickly repaired.

In view of the foregoing, it is an object of the present invention to provide an electrically heated vest. It is another object of the present invention to provide a heated vest of interchangeable and replaceable modules including electrical resistance heating elements and wiring harness. Yet another object of the present invention is to provide an electrically heated vest that is of lightweight construction. Still another object of the present invention is to provide an electrically heated vest that is easily washable. Yet another object of the present invention is to provide an electrically heated vest including interchangeable modules and wiring harness that may be easily and quickly replaced and/or interchanged and repaired.

SUMMARY OF INVENTION

Briefly, according to this invention there is provided an electrically heated vest which is comprised of interchangeable removable fastenable modules including heating elements, a removable wiring harness, a machine washable shell, and a power supply cord with thermostat. In a preferred embodiment, the interchangeable modules are anatomically shaped and identically sized. The modules are fastened to the shell via snaps, buttons, VELCRO® fasteners, and the like. The wiring harness is removable from the shell and has quick disconnects for the heating panels and power cord. The shell is machine washable, has mating fasteners for the heating elements, and an inner liner and outer shell between which the heating elements are attached. Optionally, two sleeves may be added to the vest for additional protection from the environment.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
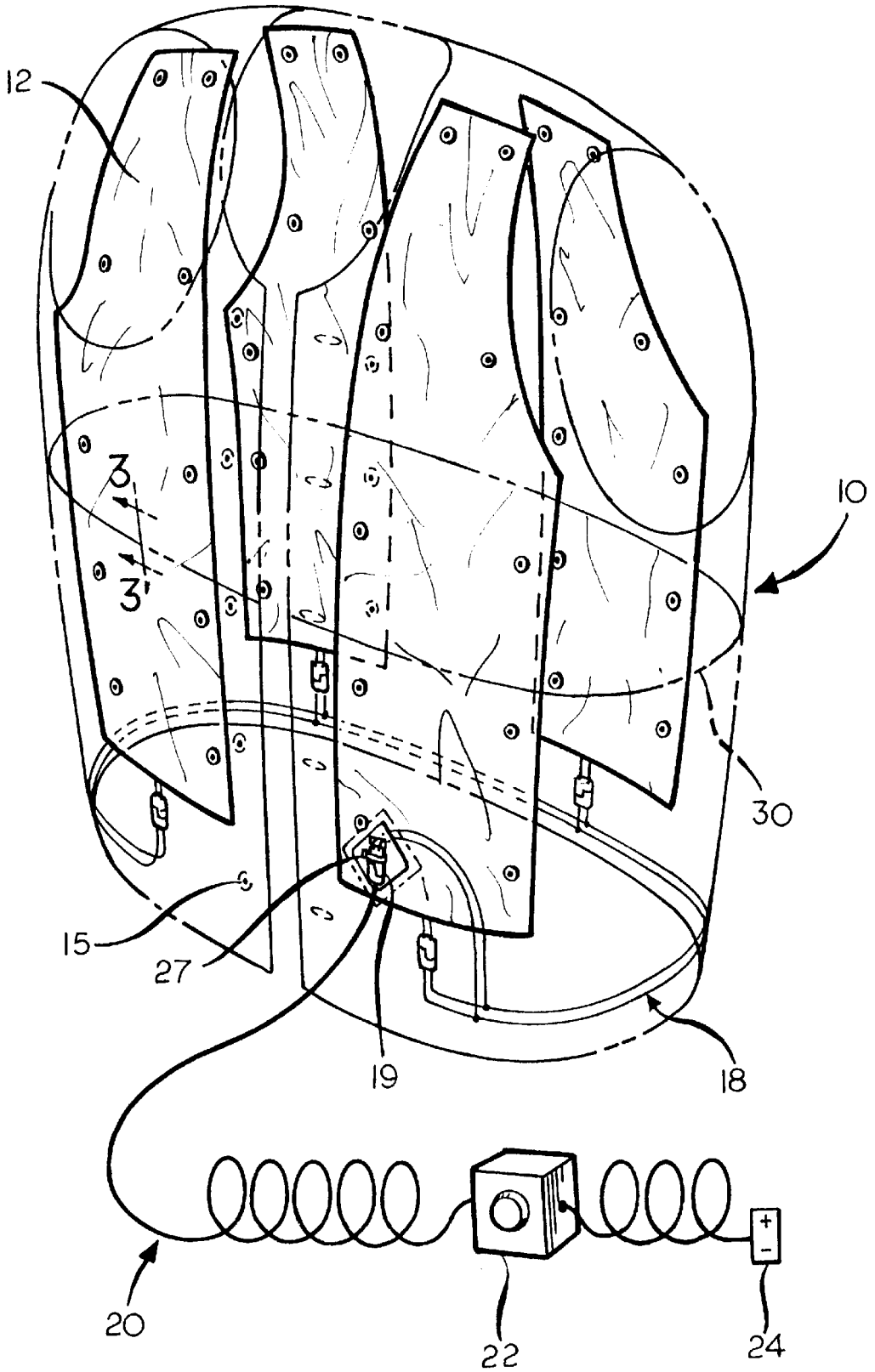
FIG. 1 is an isometric view of the invention showing all four heating elements within the vest shell.

Referring to the drawings wherein like reference characters represent like elements, FIG. 1 illustrates an electrically heated vest 10 in accordance with the present invention. The electrically heated vest 10 includes interchangeable and replaceable shaped modules 12 having at least one electrical resistance heating element 11. The modules 12 are interconnected in parallel by a removable wiring harness 18.

The electrically heated vest 10 is of a traditional garment design with overlapping front lapels forming a front opening for entry and closure of a wearer. As shown in the figures, the vest 10 includes access openings for arms, head, and waist of the wearer. The overlapping front lapels of the heated vest 10 may be closed using any conventional apparel fastener 15 including, but not limited to, snap, button, zipper and the like as well known in the art. It will be appreciated from the foregoing that the features of the present invention may be incorporated within most any garment design. Accordingly, although the present invention finds particular application as a vest style garment, other styles of garments may also be used. For example, the heated vest 10 may be of a pullover construction.

Figure 3:
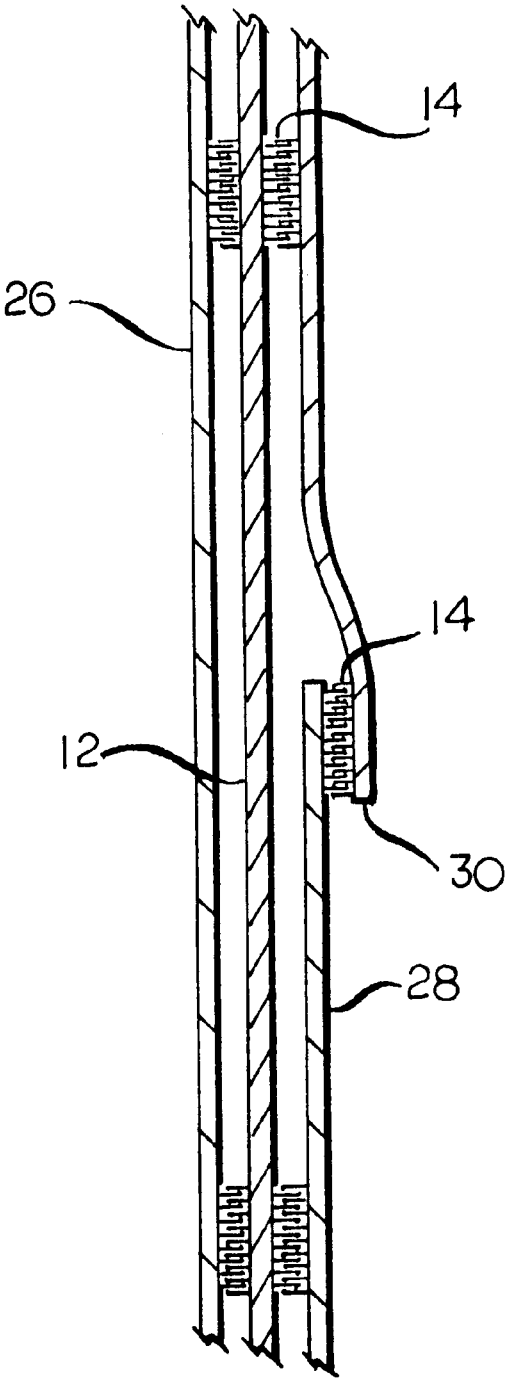
FIG. 3 is a section view showing a single heating element with VELCRO® fasteners, inner liner, outer shell, and access slit.
Figure 4:
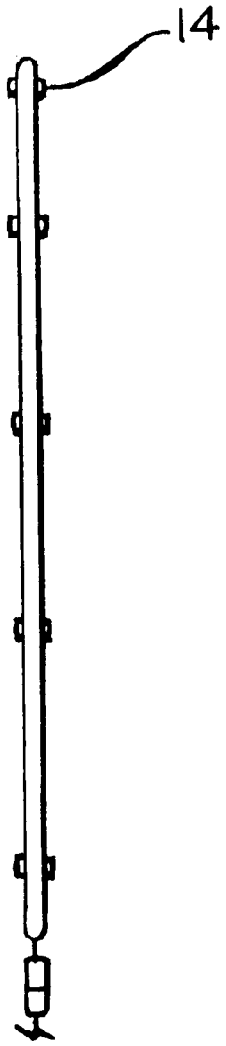
FIG. 4 is side view of a single heating element with snap fasteners when removed from the vest.

The heated vest 10 includes an outer shell 26 and an inner liner 28 as shown in FIG. 3. The outer shell 26 is attached to the inner liner 28 around the perimeter thereof to form there between a cavity. The outer shell 26 may be comprised of most any material suited for outdoor use. Preferable properties for the material forming the outer shell 26 include water resistance, breathability, and thermal insulation. As the heated vest 10 may be used as an undergarment, alternative outer shell 26 materials may include cotton, wool, a synthetic, or blend thereof. The outer shell 26 protects and shields the modules 12 and wiring harness 18 from moisture, abrasion, and the like. Additional features such as pockets and the like may be added to increase the utility of the outer shell 26. The electrically heated vest 10 may also include a storage compartment (not shown) to carry an additional spare module.

Figure 2:
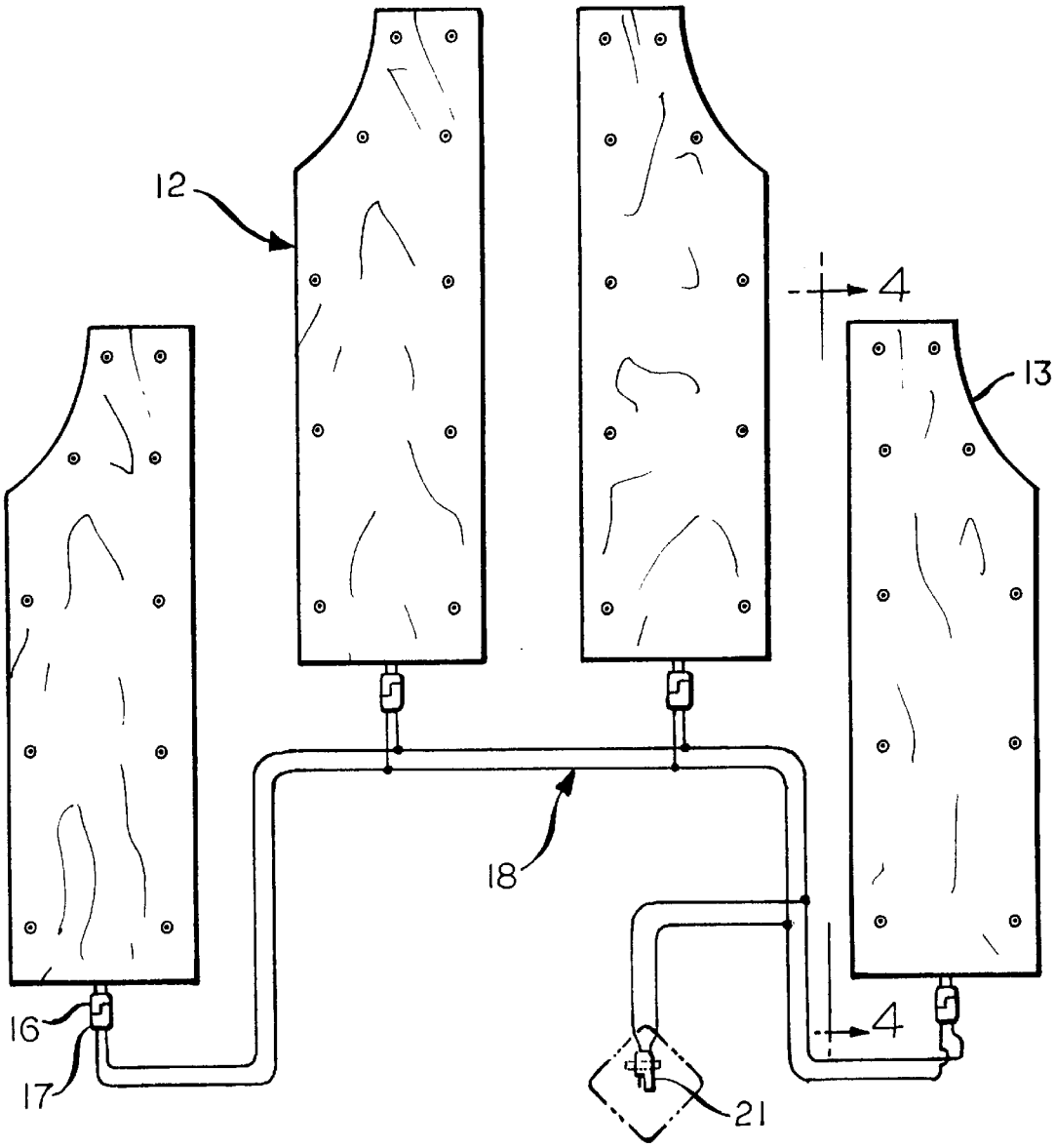
FIG. 2 is a plane view of four heating elements and wiring harness when removed from the vest.

The modules 12 are of an identical size and shape for interchangeability. Each module 12 is of a planar two-ply construction having a front surface and a back surface. The front surface and the back surface are attached about the peripheral edge thereof to form a cavity there between. Each module 12 includes within the cavity at least one heating element 11 of a type well known in the art. As shown in the figures, the heating element 11 is operatively attached within the cavity in a serpentine pattern to provide maximum exposure of the heating element to the upper torso of the wearer. In yet another embodiment, as shown in FIG. 2., the at least one heating element 11 includes a resistive fabric panel 13 of a type well known in the art comprised of carbon fibers. An example of a resistive carbon panel suitable for application in the present invention is commercially available under the trademark GORIX.

The module 12 includes fasteners 14 attached to both the back surface and the front surface to facilitate versatile attachment and right-to-left and front-to-back interchangeability of modules within the same vest. In a preferred embodiment, the vest 10 includes four anatomically shaped modules 12 having a cutout 13 with a concave curvature to provide maximum body coverage and conform to a traditional vest configuration.

As shown in FIG. 3, the modules 12 are removably fastened between the outer shell 26 and the inner liner 28 within the cavity. The modules may be fastened to either the outer shell 26 or the inner liner 28 or some convenient combination thereof For example, the modules may be fastened to the outer shell 26 or the inner liner 28 by fasteners 14 such as a quick release type fastener commonly used in the garment industry, e.g., snap fasteners, buttons, zippers, and synthetic materials that adhere when pressed together, commonly sold under the trademark VELCRO® (FIGS. 1–4). The number of fasteners 14 may range from one for a continuous zipper surrounding the perimeter of the module 12 to a nominal number of discrete fasteners as shown in FIGS. 1–4. In a preferred embodiment, ten fasteners 14 are shown per module 12 but this number may vary based on the vest size and fastener strength.

Access to the modules 12 and the fasteners 14 may be gained through an access slit 30 in the outer shell 26 and/or the inner liner 28. In a preferred embodiment, the access slit 30 is located generally horizontally around the vest 10 on the inner liner 28 as shown in FIGS. 1 and 3 to allow easy access to the upper and lower fasteners 14. In yet another embodiment, multiple access slits 30 may be used in larger vests to facilitate ease of repair. It will be appreciated that placing the access slit 30 on the outer shell 26 facilitates easy access to the modules 12 and the wiring harness 18 for repair and may be covered with a flap to shield it from adverse weather conditions. Whether placed on the inner liner 28 or the outer shell 26, the access slit 30 may be held closed using most any suitable garment fastener of a type well known in the art, i.e., zipper, buttons, snaps, or VELCRO® as previously described.

With the vest fully assembled and the access slit 30 closed, the inner liner 28 provides a barrier layer between the four modules 12 and the person wearing the garment. It will be appreciated that by using multiple intervening layers, the modules 12 do not directly contact the wearer or cause a localized heating effect thereby facilitating dissipation of the heat over the surface of the material. The inner liner 28 also absorbs perspiration and maintains a soft comfortable surface for the wearer. Materials such as cotton, wool, synthetics, and blends thereof are suitable for the inner liner 28.

The removable wiring harness 18 is disposed between the inner liner 28 and the outer shell 26. The wiring harness 18 is located within the cavity created between the liner 28 and the shell 26. As shown in FIG. 2, the wiring harness 18 receives power through an electrical connector 21 and delivers power to each of the four modules 12 through connectors 17. The wiring harness 18 maintains its location via mating electrical connectors 16 of the modules 12. The electrical connector 21 is removably fastened to the outer shell 26 through a front located lashing point and reusable tie strap 27. The tie strap 27 securely fastens the electrical connector 19 to the outer shell 26, preventing undue stress on the electrical connectors 16 and 17 and their corresponding heating elements 12. By utilizing quick release electrical connectors 16, 17, 19, 21, mechanical fasteners 14, and reusable tie strap 27, all of the modules 12 and wiring harness 18 within the vest 10 may be removed, and/or interchanged, quickly and easily by hand, without the use of any tools.

The wiring harness 18, in combination with the modules 12 form the primary heating circuit powered by power supply cord 20. In a preferred embodiment as shown in FIG. 2, the wiring harness 18 provides both positive and negative bus lines with each of the four modules 12 connected in parallel. The four electrical connectors 17 removably connect the wiring harness 18 to the modules 12 via mating connectors 16. The electrical connectors 16 and 17 are selected to allow for quick disconnection, low cost, lightweight, and full insulation to prevent current drain. It will be appreciated that the connectors 16 and 17 allow many connection/disconnection cycles between the wiring harness 18 and the modules 12. For the modules 12 including a resistive panel 23, the modules also include a top bus bar 23*a* and a bottom bus bar 23*b* interconnected by a connection wire.

The configuration of the wiring harness 18 allows for connection of the four modules in a series or parallel circuit. The parallel circuit configuration has the advantage of current delivery to three of four modules 12 upon the failure of a single module. Conversely, a series circuit may be used if low impedance heating elements 12 are selected. The failure of one module 12 in a series circuit would result in complete heating failure.

The wiring harness 18 draws power from the power cord 20. This cord is illustrated in FIG. 1 to include a control 22 and a power supply 24. The power supply 24 may be adapted to correspond to any available alternating or direct current power source. Ideally, a cigarette lighter outlet connector may be adapted to connect to the power cord 20 that is connected to a power source operatively connected to a vehicle battery. Alternatively, a battery or other self-contained power source may be used. The control 22 is used to vary the power delivered to the heating elements 12. Both manual and self-regulated control systems may be used. The feedback loop in the self-regulated control system may be based on ambient temperature, circuit resistance, or the like. The switch on control 22 may be infinitely variable or have discrete control positions. Regardless of the configuration, the power cord 20 must be designed to withstand the exposure of outdoor and low temperature use.

In use, the device 10 provides heat to the person wearing it. Upon failure of a single module 12, the wearer may simply relocate one of the other modules to the position of the failed element. Optionally, the wearer may replace the failed module 12 with a spare module. Additionally, should the wiring harness 18 or power supply cord 20 fail to provide power to the modules, they are also easily accessible for replacement. All of the modules 12, wiring harness 18, or power supply cord 20 may be replaced or interchanged quickly, easily, and without the use of tools.

It will, of course be understood that various details of construction may be varied through a wide range without departing from the principles of this invention and it is, therefore, not the purpose to limit the patent granted herein otherwise than necessitated by the scope of the appended claims.

What is claimed is:

1. An electrically heated vest comprising:

an outer shell and an inner liner having a perimeter, the outershell being attached to the inner liner around a substantial portion of the perimeter to form a cavity therebetween;

a plurality of interchangeable, identically sized modules each including a heating element, the modules removably fastenable between the outer shell and the inner liner within the cavity;

a wiring harness having a plurality of electrical connectors operatively connected to at least one heating element of each module and removably fastenable between the outer shell and the inner liner within the cavity; and a power supply cord connected to the wiring harness and having a power control and an electrical connector operatively attached to a source of electrical power; the modules, wiring harness and power supply cord being removably fastened to the outer shell for repair or replacement.

2. The electrically heated vest of claim 1 wherein each of the interchangeable modules is removably fastenable using at least one fastener located on the front side and the back side of the module.

3. The electrically heated vest of claim 2 wherein the wiring harness defines a parallel circuit when connected to the modules.

4. The electrically heated vest of claim 2 wherein the power control includes a feedback loop.

5. An electrically heated vest comprising:

a fabric shell that defines openings for arms, head, and waist having an inner liner defining a liner periphery and an outer shell defining a shell periphery, at least a portion of the peripheries secured together;

a plurality of interchangeable, identically sized modules each including a heating element having an electrical connector and means for attachment to the fabric shell;

a removable wiring harness disposed between the inner liner and the outer shell having a plurality of electrical connectors for providing power to the modules;

a power supply cord, a means for controlling power and an electrical connector for providing power to the wiring harness;

the plurality of interchangeable modules being disposed between the inner liner and the outer shell and removably attached to the fabric shell;

the removable wiring harness being removably connected to the plurality of modules; and the power supply cord being removably connected to the wiring harness;

whereby the modules, the wiring harness, and the power supply cord are removable from the fabric shell.

6. The electrically heated vest of claim 5 wherein each interchangeable module has a front side and a back side; and the means for attachment of the modules includes one or more fasteners located on the front side and the back side of each module.

7. The electrically heated vest of claim 6 wherein the wiring harness defines a parallel circuit when connected to the modules.

8. The electrically heated vest of claim 6 wherein the means for controlling power includes a feedback loop.

9. The electrically heated vest of claim 6 wherein the wiring harness is attached to the fabric shell using a removable tie strap.

10. The electrically heated vest of claim 1 wherein said plurality of interchangeable, identically sized modules include four of said modules.

11. The electrically heated vest of claim 1 wherein said heating element is a resistive fabric panel.

12. The electrically heated vest of claim 5 wherein said plurality of interchangeable, identically sized modules include four of said modules.

13. The electrically heated vest of claim 5 wherein said heating element is a resistive fabric panel.

* * * * *